US005519980A

United States Patent [19]

Guentert et al.

[11] Patent Number: 5,519,980

[45] Date of Patent: May 28, 1996

[54] FILLING DEVICE FOR FILLING INTO MAGAZINE CHAMBERS

[75] Inventors: Bernhard Guentert, Mühlhausen-Ehingen; Reinhold Jaeger Waldau, Radolfzell; James D. Wiggins, Bodman-Ludwigshafen, all of Germany

[73] Assignee: Ing. Erich Pfeiffer GmbH & Co KG, Radolfzell, Germany

[21] Appl. No.: 199,411

[22] Filed: Feb. 22, 1994

[30] Foreign Application Priority Data

Feb. 26, 1993 [DE] Germany ..... 43 05 879.5

[51] Int. Cl.[6] ..... B65B 1/16; B65B 1/26; B65B 7/00

[52] U.S. Cl. ..... 53/268; 141/67

[58] Field of Search ..... 141/5, 67, 249; 53/268, 274, 275, 281

[56] References Cited

U.S. PATENT DOCUMENTS

| | | | |
|---|---|---|---|
| 3,334,666 | 8/1967 | Vogt | 141/5 |
| 4,083,607 | 4/1978 | Mott | 141/67 X |
| 4,279,279 | 7/1981 | Schevey et al. | 141/5 |
| 4,504,739 | 3/1985 | Weissenfluh | 141/5 X |
| 4,545,410 | 10/1985 | Paul et al. | 141/67 X |
| 4,550,755 | 11/1985 | Vredenburg, Sr. | 141/67 X |
| 4,586,549 | 5/1986 | White | 141/67 |
| 4,640,322 | 2/1987 | Ballester | 141/67 X |
| 4,872,493 | 10/1989 | Everman | 141/67 X |
| 4,976,296 | 12/1990 | Pope | 141/67 X |
| 5,222,529 | 6/1993 | Zoltan et al. | 141/4 |

FOREIGN PATENT DOCUMENTS

3230694A1 2/1984 Germany .

OTHER PUBLICATIONS

Duetsches Patentamt, Ergebnis Druckschriftenermtiilung, Sep. 28, 1993.

*Primary Examiner*—Horace M. Culver
*Attorney, Agent, or Firm*—Quarles & Brady

[57] ABSTRACT

A magazine body (2) with a plurality of radial magazine chambers (3) by insertion in an axial fastening device (20) with chamber inlets (4) is made to coincide with a medium passage opening (30) and with outlets (5) is made to coincide with a connecting opening (33) of a suction head (17), so that the medium occurs in uninterrupted manner at the inlets (4). The suction head (17) evacuates all the magazine chambers (3) and then filled via the passage (30) from a medium supply (12) and against a medium retaining device (36). With the ejection of the filled magazine chambers (33) the inlets and outlets (4, 5) are closed in medium-tight manner by stripping from closure parts (8, 9).

28 Claims, 5 Drawing Sheets

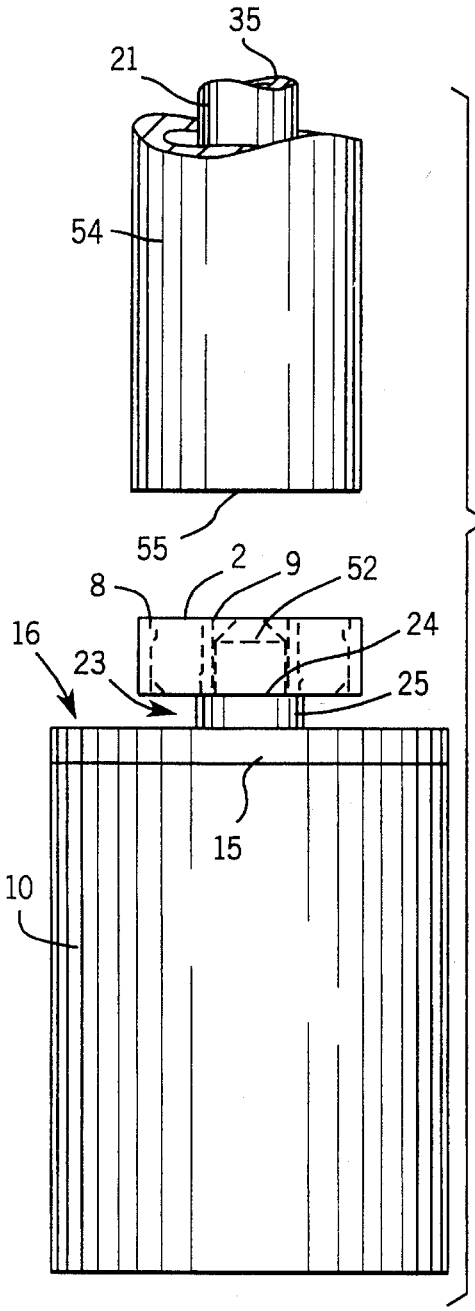
FIG. 6
FIG. 7
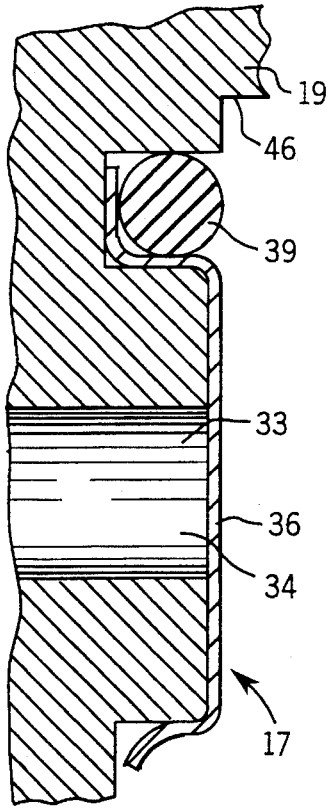

FILLING DEVICE FOR FILLING INTO MAGAZINE CHAMBERS

BACKGROUND OF THE INVENTION

The invention relates to a filling device for filling flowable media into magazine chambers. Such media can be gaseous, viscous, thin, pulverulent and/or powder-like or a mixture thereof and the media are or contain more particularly pharmaceutical, cosmetic and similar products. Although much larger quantities can be involved, the filling device is more particularly used for filling very accurately or low-toleranced dosed minimum quantities of below 10 g down to less than 1 mg and, as a function of the particular requirements, the dosing quantity can be modified between these limits in steps of 1 mg and the filling accuracy tolerance can be below 1/10, 1/100 or 1/1000 g.

Magazine bodies having such magazine chambers can e.g. be constructed according to European patent application 92 114 370.7 (U.S. application Ser. No 936,743, filed Aug. 27, 1992 and now U.S. Pat. No. 5,366,122) and can be usable for the dose dispenser described therein and reference should be made to said document for the incorporation of the corresponding features and effects into the present application. The magazine body can be constructed in the manner of a drum magazine, a slide magazine, etc. and a dose dispenser can receive several identical and/or different magazine bodies and/or several dose dispensers can be combined into a discharge unit for simultaneous and/or independent actuation.

OBJECTS OF THE INVENTION

An object of the invention is to provide a filling device of the aforementioned type, in which disadvantages of known constructions are avoided and which in particular permits a weight or volume-accurate filling of even small to very small medium quantities in the case of a relatively simple construction.

SUMMARY OF THE INVENTION

According to the invention the magazine chamber to be filled is supplied with a feed flow over at least part of its volume and which contains or forms one or more media, the medium being stored in the magazine chamber. It is possible to provide successive feed flows, e.g. for the successive filling of the magazine chambers with individual batches or charges, or only a single and in particular intermittent feed flow. The feed flow can be deflected in the magazine chamber e.g. back to the inlet, or may only be substantially guided in a single flow direction through the magazine chamber. The particular feed flow can be substantially separated from the incorporated medium e.g. in such a way that the magazine chamber is not filled accompanied by voids and instead this takes place in a complete and uninterrupted manner with the medium, which is appropriately stored with a low storage pressure or is compressed. Thus, in the case of a pulverulent medium, between the individual medium particles there merely remain smallest residues of the feed medium enclosed in the magazine chamber. The feed medium can have the aggregate states described hereinbefore. For example, a liquid feed medium could be used, whilst applying lyophilization.

Appropriately the feed medium is constricted in the vicinity of the magazine chamber inlet or outlet, e.g. at the chamber inlet by a substantially tightly connected medium supply or at the chamber outlet by a medium holding-back device, which prevents a discharge of the medium from the magazine chamber together with the feed flow, but permits the passage of the latter. Initially the medium is torn from the medium supply with the feed flown and, accompanied by compression, is hurled against the medium holding-back device in such a way that it initially closes the latter or the chamber outlet substantially over the entire flow cross-section. The medium torn from the medium supply gradually fills the medium chamber in the direction away from the holding-back device, so as to gradually fill in the direction of the chamber inlet, so that it uninterruptedly engages on the chamber jacket and is linked to the chamber ends.

Advantageously the feed flow is in the form of a suction flow or the magazine chamber is placed under a vacuum for filling purposes, so that the medium is drawn or sucked into the magazine chamber. If a flow restrictor is located in the vicinity of the chamber inlet, then the said restrictor avoids excessive flow rates and an excessive compression of the medium in the magazine chamber. As a result of the medium supply at the chamber inlet, it is ensured that the medium is taken up by the feed flow over the entire flow cross-section of the magazine chamber and therefore over said cross-section is fed in substantially uniform manner into the magazine chamber. The medium can be released from the medium supply accompanied by whirling up and immediately thereafter is compressed in a compact manner by impact. The vacuum filling ensures a very high dosing accuracy, e.g. through complete filling of the magazine chamber. The accuracy of the filling can be improved in that before, during or after the filling process the medium supply, the medium store, the medium body, the medium connection, which at least partly moves the feed flow inlet and/or the complete device associated with the chamber outlet is e.g. vibrated, shaken, tilted, rotated and/or moved in same other way, e.g. in order to constantly refeed the medium supply to maintain the necessary level.

The medium supply can, in the manner of a column store, have a much larger filling length or height compared with its cross-sections, so that the uniform afterflow over the entire cross-section is facilitated. Appropriately the medium supply is connected across a slot-like, elongated, passage opening or corresponding passage channel to the chamber inlet, the flow cross-sections of the channel or opening being much smaller than those of the medium supply and their flow direction can be at right angles to that of the remaining medium supply, so that there is an angular feed movement and the opening or channel is constantly filled up. The feed path in the passage channel can be roughly the same as the maximum feed path in the magazine chamber or can be below the same. For example the passage channel may only pass through a single wall or can be bounded by facing edge or front faces of two walls. The passage channel length corresponding to the feed path can be approximately the same as the inside cross-sectional width of the medium supply or can be below this.

At the chamber opening the medium present after filling is removed appropriately by shearing approximately parallel to the opening plane and as a result is optionally so smoothed that it terminates flush with the medium body surface traversed by this opening. Following filling the chamber opening is closed advantageously in a substantially medium-tight manner and shearing can take place beforehand with a feed flow-guiding feed head, an edge of the passage opening, a surface traversed by the said opening and/or a closure part. The closure part is appropriately fitted in such a way that under tension and/or by means of a snap connection it substantially covers the complete associated surface of the magazine body.

The magazine body and/or the closure part is advantageously made from plastic or some other suitable metallic or nonmetallic material having smooth surfaces. Thus, the magazine body can be constructed as a valve body of a slide valve or some other valve which e.g. by a relative movement can close and in particular open the passage opening in such a way that without any additional or separate seals is connected substantially in medium-tight manner to the chamber inlet. The smallest cross-sectional width of the passage opening or channel appropriately corresponds to the internal diameter of the magazine chamber, which can be substantially constant over its entire length.

It is particularly appropriate for the chamber outlet to be closed with a slide valve-like covering with a closure part and then for the magazine body to be carried along with the slide valve movement in such a way that the medium at the chamber inlet is firstly sheared and then the chamber inlet is closed by slide valve-like joining together with a further closure part.

The filled magazine body, which appropriately has a plurality of completely separated, simultaneously and/or successively filled medium chambers, after closure, forms a cartridge or a replacement magazine for the dose dispenser. In the latter the individual magazine chambers can be emptied independently of one another or the content of each magazine chamber can be discharged with a single discharge surge or with a feed flow, which once again enters through a chamber opening and exits through a further chamber opening. If the medium outlet is the chamber outlet for the feed flow of the filling device, a particularly favourable flow behaviour is obtained. The filling volume of the magazine chamber is preferably between 1 and 20 mg.

BRIEF FIGURE DESCRIPTION

These and further features of the invention can be gathered from the claims, description and drawings and the individual features, either singly or in the form of subcombinations can be realized in an embodiment of the invention and in other fields and can represent advantageous, independently protectable constructions for which protection is hereby claimed. An embodiment of the invention is described in greater detail hereinafter relative to the drawings, wherein show:

FIG. 1 A detail of a filling device according to the invention in a larger scale axial section and after ending the filling phase.

FIG. 2 The device according to FIG. 1 in a smaller scale axial section during the filling process.

FIG. 3 The filling device shortly after the phase according to FIG. 1.

FIG. 4 The filling device during the closure phase.

FIG. 5 The filling device at the end of the closure phase.

FIG. 6 The filling device on ejecting the magazine body.

FIG. 7 A detail of FIG. 1 on a much larger scale and in a slightly modified construction.

FIG. 8 The filling device in a sectional, perspective view and in a slightly modified construction.

DETAILED DESCRIPTION OF PREFERRED EXAMPLE EMBODIMENTS

Figure 1:
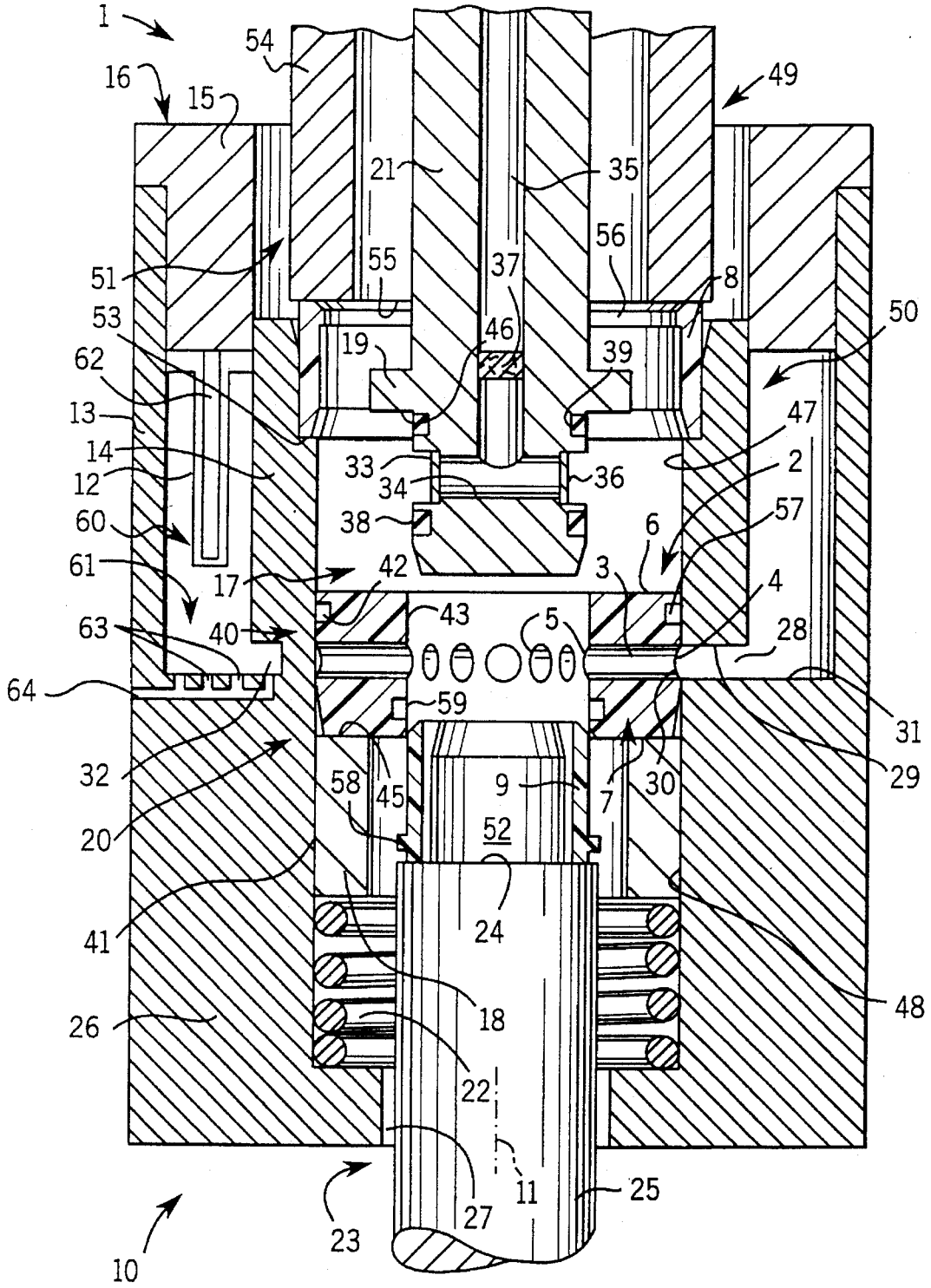

The filling device 1 is used for filling a shallow, annular magazine body 2, whose axial extension, e.g. is at least half smaller than its external diameter and is roughly the same as its internal diameter or less. The magazine body 2 has around its central axis radially distributed and directed, through, linear magazine chambers 3 in the form of bores, which are located in a common plane and whose through, cylindrical inner walls are formed in one piece by the magazine body 2. The number of magazine chambers 3 can e.g. be between 8 and 24 and in particular between 12 and 18, their length being between at least two or three times greater than their internal diameter. The magazine chambers 3 traverse the magazine body 2 on the cylindrical outer circumference with separate inlets and on the inner circumference with separate outlets, whose intermediate spacings can be smaller than the internal diameter, which in turn corresponds to the width of the remaining magazine chamber 3. The magazine body 2 forms two remote, through, planar and reciprocally parallel end faces 6, 7, whose reciprocal spacing roughly corresponds to four times the internal diameter of the magazine chambers 3. The circular openings of the inlets 4 and the outlets 5 can in each case be closed with a sleeve-like closure part 8 or 9, which exclusively in an axial plugging movement can be so joined to the magazine body 2, that in each case two faces of both closure parts 8, 9 terminate flush with the associated face 6 or 7. The closure parts 8, 9 are of identical length.

The device 1 e.g. built up on a support frame has a positionally fixed body 10 with a vertical axis 11, in which are located substantially all the device parts and in the filling position also the magazine body 2. At the upper end the body 10 forms a cross-sectionally annular or cylindrical storage chamber 12, which is radially outwardly bounded by a circumferential outer wall 13 formed by the body 10 and radially inwardly by a circumferential inner wall 14. Substantially over its entire height the storage chamber 10 has a constant internal diameter and therefore a two to four or five times greater height and at its upper end it is closed by a cover 15 inserted in centred, sealed manner in the outer wall 13 and inner wall 14. Following axial removal an annular filling opening is freed for the storage chamber 12, whose capacity is a multiple of the reception volume of a magazine body 2. The cover 15 can seal in medium-tight or non-medium-tight manner, e.g. by different rotary positions, so that an interruption of the feed flow during a filling cycle is avoided, but despite this a venting of the storage chamber can be obtained.

Together with the components carried by it, e.g. the cover 15, the body 10 forms a lower feed head 16 into which can be introduced an upper feed head 17 parallel to the axis 11 and at the top can be completely moved out, so that the upper opening of the feed head 17 is freely accessible e.g. for inserting and removing the magazine body.

Below the storage chamber 12 in the body 10 is axially displaceably mounted a circumferential adjusting member 18, which is formed by a cylindrical sleeve with planar faces, the upper face serving as a stop face, tensioning face, abutment face and/or pressure face for the face 7. The corresponding adjusting member 19 associated with the upper face 16 of the magazine body 2 projects on the outer circumference of the feed head 17 as a collar constructed in one piece therewith and forms with its lower face at least one of the faces referred to in connection with the adjusting member 18 with respect to the face 6. In the filling position the magazine body 2 is fixed in aligned manner with respect to the body 10 by substantially radial clearance-free guidance and an axially acting fastening device 20, the fastening members of the latter being formed by the adjusting members 18, 19. The adjusting member 19 is forcibly guided with the feed head 17 by means of a drive, e.g. a pneumatic or hydraulic cylinder-piston unit in two opposite movement directions and with this drive is positively connected by means of a hollow adjusting rod 21 connected at the top to the adjusting member 19. The adjusting member 18 is moved with respect to the body 10 with the tension of an adjusting spring 22 arranged flush in the body 10 and which is supported on the face of the adjusting member 18 remote from the magazine body 2 and can determine the fastening or tensioning force of the fastening device 20.

As in the filling position the magazine body 2 is located by a multiple of its axial extension deeply embedded in the body 10, for removing the magazine body 2 after filling an ejector 23 is located in the axis 11 and its effective, maximum external diameter, like that of the feed head 17 with the adjusting member 19, is smaller than the external diameter of the magazine body 2. The ejector 23 movable in and substantially downwardly out of the adjusting member 18 forms with an upper face an annular adjusting member 24 for engaging running up on the face 7, so that the latter is raised from the adjusting member 18. The adjusting member 24 is provided in the vicinity of the upper end of an adjusting rod 25 passed downwards out of the body 10 and which can be forcibly driven by a drive of the described type and traverses in contact-free manner the adjusting spring 22 or the adjusting member 18. Directly following on to the lower end of the storage chamber 12 the body 10 forms a base 26, whose internal diameter is smaller than the external or internal diameter of the storage chamber 12 and in which the adjusting member 18 and the adjusting spring 22 are movably mounted in substantially radial clearance-free manner.

At the lower end the base 26 forms a passage 27 for the adjusting rod 25 which is narrower compared with said bearing width and which simultaneously forms a ring slot-like ventilating opening for the base space receiving the adjusting member 18, the adjusting spring 22 and part of the magazine body 2, as well as optionally for the storage chamber 12. At the lower end the storage chamber 12 passes into an annular or disk-shaped passage channel 28, which is cross-sectionally connected in radially inwardly directed manner to the inner circumferential wall of the storage chamber 12, passes substantially uninterruptedly around the axis 11 and has a length corresponding to its radial extension, which is smaller than the internal diameter of the storage chamber 12. At the radially inner end, namely in the inner circumference of the inner wall 14, the passage channel 28 terminates in a connection or passage 30, namely a ring or slot opening passing uninterruptedly round the axis 11. The passage channel 28 and the passage 30 are bounded at the upper end face by the lower, planar edge face 29 of the chamber boundary 14, whilst at the lower end face they are bounded by the parallel, planar bottom face 31 of the storage chamber 12 and which passes continuously up to the passage 30.

Over its entire radial extension and entire circumference the passage channel 28 has a constant width and in axial section forms an angular, reduced passage cross-section extension of the storage chamber 12. The width or diameter of the passage channel 28 and passage 30 parallel to the axis 11 are the same as the width or diameter of the magazine chamber 30 or the chamber openings 4, 5, whilst at right angles thereto the passage width is much larger, so that medium can flow in not only parallel, but also in inclined manner from the side of each inlet and upstream of each inlet 4 is a laterally projecting medium volume. The optionally smallest width of the passage channel is below 10 to 5 or 2 mm, preferably being 1 mm.

For the centred retaining of the inner wall 14 in the passage spacing from the bottom face 31 on the body 10 there are angular ribs 32 distributed around the axis 11 and which subdivide the storage chamber 12 into individual, radially uninterrupted axial shafts separated only by a single partition and keep the inner wall 14 centred on the through cylindrical outer circumference and axially support same on a radially outer part of the edge face 29. Therefore the shaft partitions pass in the flow direction roughly over half the length of the passage channel 28, but not into the vicinity of the passage 30, so that the latter is formed by a ring area of the passage channel 28 completely uninterrupted over the circumference. The length of the passage channel 28, plus the medium length fixed in its radial longitudinal direction in the medium chamber 12 is approximately or at least as large or larger than the length of the magazine chamber 3.

The inner wall 14 can extend into the vicinity of an inner bore of the annular or sleeve-like cover 15, so that the latter sealingly cooperates with the outer circumference of the inner wall 14 and with its inner face is at a limited distance from the upper ends of the ribs 32. The inner wall 14 can form a separate component from the body 10 or base 26, but is appropriately constructed in one piece therewith and smallest spacing extensions axially bridge the passage channel 28 and can interrupt same at a few points. However, the inner wall may only be connected via the ribs 32 to the remaining body 10. The storage head 17 projecting over the lower face of the adjusting member 19 by approximately or slightly more than the length of the magazine body 2 has on the outer circumference at least one connecting opening 33 for the outlets 5. For each outlet 5 it is possible to provide a separate, wider connecting opening 33 or a cannon connecting opening 33 can be provided for all the outlets 5 and is formed by an annular groove on the outer circumference of the feed connection or head 17 and in the axial direction has a width which is the same or larger than the associated inside width or diameter of the outlets 5. The connecting opening 33 is connected at the two remote ends of at least one radial or transverse channel 34 or is formed by its ends. The channel 36 is connected roughly in the centre of its length to the lower end of a longitudinal channel 35 traversing the adjusting rod 21. In the vicinity of the connection of the adjusting rod 21 with the associated drive the longitudinal channel 35 and therefore the connecting opening 33 is to be connected to a feed or suction source, accompanied by the interposing of an operating valve, which can be opened or closed by a handle, pedal, path-dependent control by the feed head 17, a time-dependent control, etc. The flow cross-section of the longitudinal channel 35 is larger than the connection cross-section of the transverse channel 34 roughly the same as the particular magazine chamber 3 with magazine openings 4, 5 or said cross-section is roughly the same as the channel 28.

In the flow path between an area of the outlet 5 and in the flow direction following the same during the filling process is provided a holding-back or retaining device 36 for the medium, e.g. a taut sieve, whose flow path or thickness is as small as possible and namely much smaller than the flow width or is 1 or 0.5 mm. According to FIG. 1 the retaining device 36 is located on the bottom face of the connecting opening 33 or on the associated end of the transverse channel 34, whilst preferably according to FIG. 7 it is so positioned on the outer circumference of the feed head 17, that it can engage with limited friction or radial pressure on the inner circumference of the magazine body 2 traversed by the outlets 5 and consequently closes the outlets 5 in a directly flush manner with said inner circumference, optionally without passing through the outlet 5 into the magazine chamber 3. Therefore the transition between the openings 5, 34 is sealed in medium-tight manner.

The sieve 36 produced from a flat, flexible material can, according to FIG. 7, be radially and/or axially braced with respect to the outer circumference of the feed head 17 and is appropriately easily replaceable in non-destructive manner. Axially and on either side of the connecting opening 33 is provided on the outer circumference of the feed head 17 an annular groove, whose spacing from the connecting opening 33 is smaller than its groove width and there is also an annular groove with corresponding spacing adjacent to the bracing or end face of the adjusting member 19. In said annular grooves it is possible to so non-destructively removably insert under pressure O-rings or packings 38, 39 in such a way that in the associated edge of the sieve 36 they brace same in locking manner against at least one groove side and/or the groove bottom, so that the sieve 36 is then tensioned over the connecting opening 33 and is axially positively held on either side thereof. The sieve 36 can pass in one piece over the entire circumference of the feed head or connecting opening 33 and can be placed as a band portion in through circumferential manner around the feed head 17. In place of the seals or packings 38, 39 passing at the most up to the outer circumference of the feed head 17, they can also slightly radially project, so that they pass under sealing pressure in engagement with the inner circumference of the magazine body and axially seal on either side the connection between the outlets 5 and the connecting opening 33. At a limited distance from the transverse channel 34, it is possible to provide in the longitudinal channel 35 a further sieve or a much thicker filter 37, which collects micronized powder particles which may have passed through the sieve 36 and can be easily replaced in non-destructive manner by appropriate means.

With the passage 30 is associated a valve 40, which is constructed as an axial slide valve and whose valve bodies or faces 41, 42 are formed by the adjusting member 18 and the magazine body 2, the valve opening being formed by the passage opening 30. The inner, cylindrical circumferential surface 47 of the inner wall 14 remote from the storage chamber 12 has the same cross-section or bearing width as the reception bore 48 for the adjusting member 18 and said width is adapted to the outer circumference of the magazine body 2, so that the inner wall 14 into the base 26 forms a sliding guide for the magazine body 2 or the valve faces 41, 42 and this sliding guide, spaced between its ends, is traversed by the passage 30.

With the feed head 17 extended, the magazine body 2 can be inserted from above through the cover 15 into the inner wall 14 and can then be moved in radial clearance-free manner by stop or path control into the vicinity of the base 26 or into the filling position in such a way that all its inputs 4 coincide with the passage 30. With the magazine body 2 not inserted, the adjusting member 18 is so moved by the spring 22 that the valve face 41 formed by its outer circumference or its centring and sliding face extends into the inner circumference of the inner wall 14 and closes the passage 30 in medium-tight manner.

Figure 4:
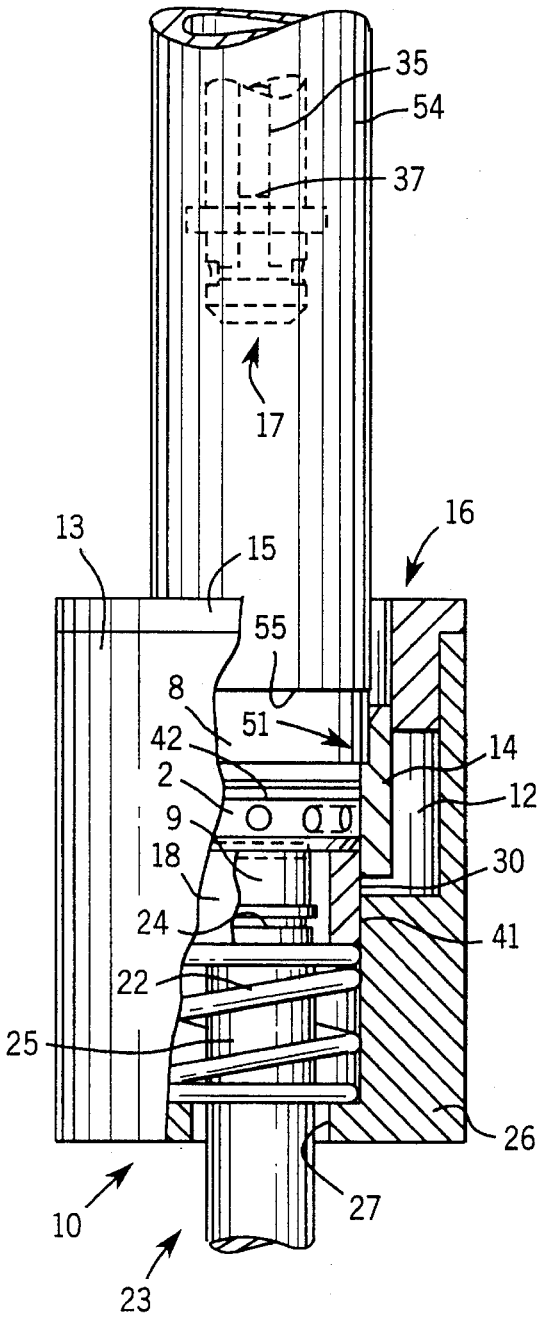

On inserting the magazine body 2 its face 7 runs up against the face 45 of the adjusting member 18, carries the latter with it counter to the tension of the valve or adjusting spring 22, moves the valve face 41 out of the vicinity of the passage 30 and without any intermediate opening of the passage 30 brings its valve face 42 into the closed position with respect to the passage 30 until the inlets 4 are made to coincide and consequently all the inlets 4 are connected to the now open passage 30. Thus, according to FIGS. 4 and 5, the adjusting member 18 always then forms a store closure 44 controlled by a restoring spring 22, if there is no magazine body 2 in the vicinity of the passage 30. The face 45 of the adjusting member 18 associated with the face 7, the corresponding face 46 for the adjusting member 19 for the face 6, the guidance or inner circumferential surface 47 of the inner wall 14 and the corresponding face 48 of the base 26 for the valve faces 41, 42 can be seen in FIG. 1.

The inventive construction gives rise to feed means 50, with which all the magazine chambers 3 of a magazine body 2 can be flown through by a feed flow from one end to the other, so that they are completely filled. The filling process according to the invention can be performed with the described or some other device. There are also means 49 for closing the magazine chambers 3 with the closure parts 8, 9 in such a way that this closure takes place without any intermediate storage of the magazine body 2 and after filling in conjunction with movements which are in any case necessary after the filling process, e.g. for ejecting the filled magazine body 2.

Figure 2:
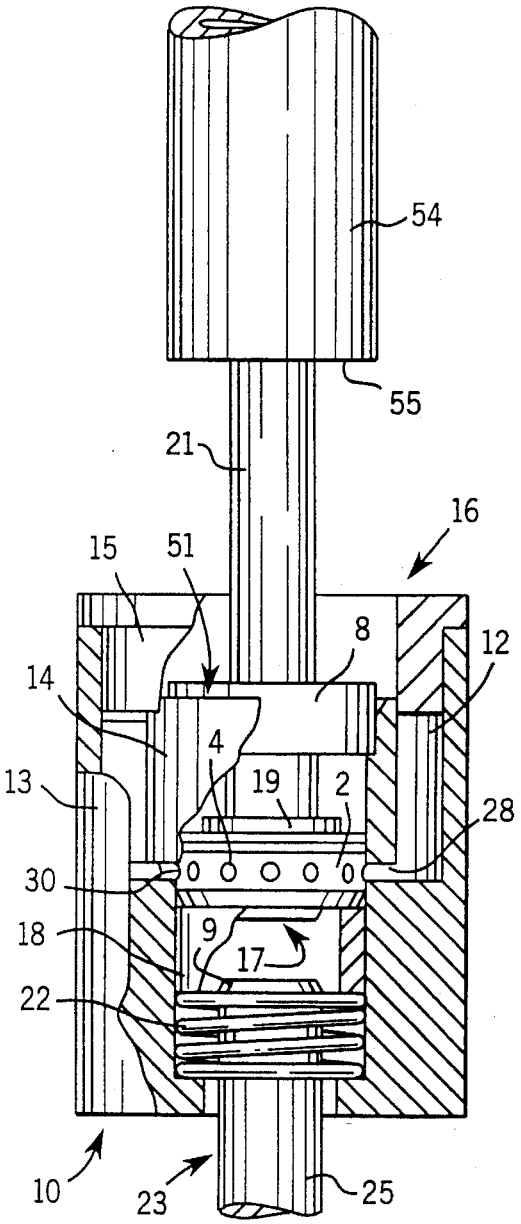
Figure 3:
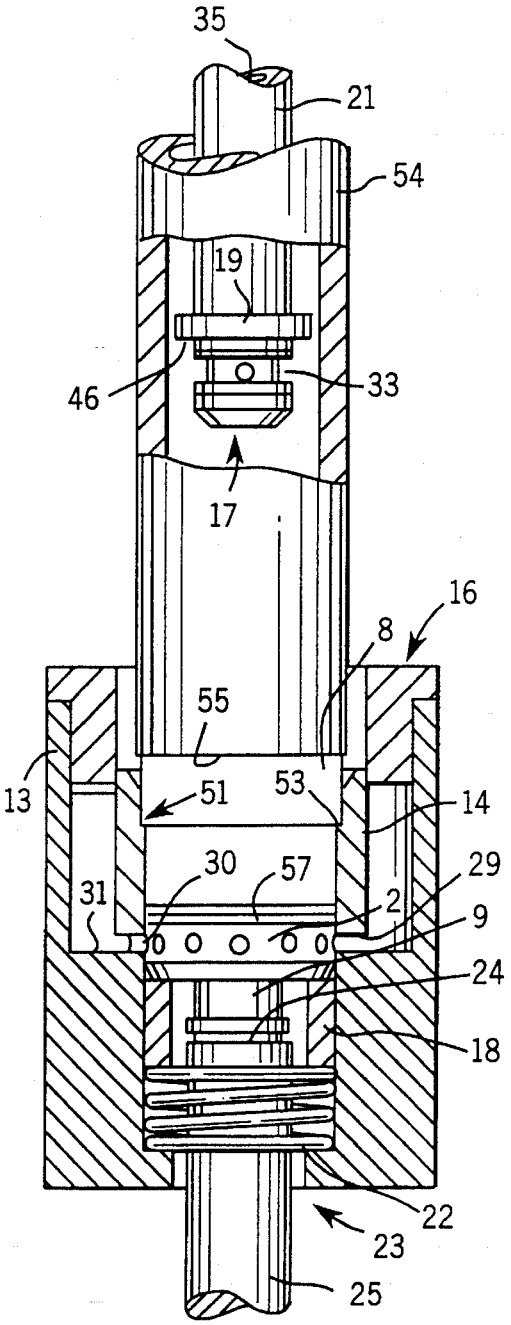

With the feed head 17 accessibly advanced on it is initially engaged a closure part 8 and then on the outer circumference with its face 6 at the front is placed a magazine body 2, which then as a result of the sealing pressure of the packings 38, 39 and the engagement on the retaining device 36 is frictionally secured. Appropriately the feed head 17 is provided at the front end with an acute angled, conically tapering insertion face, so that there is no need for the latter on the through, cylindrical inner circumference of the magazine body 2. However, with respect to the face 7, its outer circumference can form a corresponding insertion face for the inner circumference 47, which therefore requires no such insertion face. With the magazine body 2 engaged in this way with the face 46 and with the ejector 23 retracted the feed head 17 is telescopically advanced into the feed head 16 through the cover 15 and the inner wall 14, the face 7 running onto the face 45 and the valve, closure or adjusting member 18 is carried along from the closed position counter to the spring 22 in a continuously progressing advance movement until, in place of the adjusting member 18, the magazine body 2 passes into the described coinciding position with the passage 30, cf. FIGS. 1 to 3.

By shaking, vibrating, whirling up or the like it is ensured that the medium passes uninterruptedly and in void-free manner up to the passage 30 in the storage chamber 12 solely by being moved by its gravity towards said passage 30. By operating the control valve of the feed head 17, whose opening time can optionally be ended by a timer, for a short time via the channels 35, 34 and the connecting opening 33 each magazine chamber 3 is simultaneously evacuated through the outlet 5, so that the medium at the approximately uninterruptedly connected openings 34 is suddenly sucked into each magazine chamber 3 and against the outlet 5, as well as the retaining device 36. The medium subsequently stored at and in the passage channel forms a gas seal against the sucking in of gas through the passage opening.

The medium at the opening 30 can be previously smoothed by the sliding movement of the faces 41, 42 and is slightly compressed, so that it is sucked in the manner of a plug over the entire cross-section and uniformly into the magazine chamber 3. During this filling phase the cartridge holder or feed head 17 is axially, radially and/or in rotary manner permanently moved, e.g. shaken and said movements are transferred to the magazine body 2 and the magazine chambers 12, so that a void-free afterflow of the medium to the passage 30 is always ensured. During suction and with increasing distance each inlet 4 has available to it an increasing inflow cross-section of the medium in the passage channel 28, so that each inlet 4 can suck in funnel-shaped widening manner from the medium.

Through the suction process the medium is packed against the retaining device 36 and from the latter builds up uninterruptedly to the inlet 4, although it is conceivable in the case of media having corresponding characteristics that the vacuum surge leads to the release of a dosage quantity from the passage channel 28 and this dosage quantity in the manner of a released plug is directly introduced into the medium chamber 3 and is consequently possibly further compressed. It is also conceivable to provide for each inlet 4 a separate passage 30 or passage channel 28 having the same width, e.g. in that projections project over the edge face 29 and rest on the bottom face 31.

After closing the control valve of the feed head 17, the latter is either moved by its drive out of the magazine body 2 or is retracted by carrying along by the spring 22 together with the magazine body 2. In both cases the adjusting member 18 and the magazine body 2 are moved by the spring 22 relative to the passage 30 in such a way that firstly the magazine body 2 and directly following the adjusting member 14 close the passage 30 and the faces 41, 42 brush along the medium at the passage 30. If the feed head 17 is carried along during this process the outlets 5 remain tightly closed by it or the retaining device 36.

Throughout the process the ejector 23 was out of engagement with the magazine body 2. By opening the associated control valve the ejector is moved against the feed head 17 or with the adjusting member 24 against the magazine body 2, so that simultaneously or synchronously the driveless feed head 17 is carried along and can be moved out of the magazine body 2. Synchronously the inner closure part 9 belonging to the outlets 5 is moved into the inner circumference of the magazine body 2, said inner circumference previously having formed a coupling face 43 for the outer circumference, the retaining device 36 and the packings 38, 39 of the feed head 17 and subsequently formed a coupling face for the closure part 9. As in the case of the uninterrupted closure of the passage 30 by successive engagement of the valve faces 41, 42, there is here a similar uninterrupted closure of the outlets 5 by successive engagement of the outer circumference of the feed head 17 and the closure part 9. As a result of the displacement movement of these faces the medium at the outlets 5 can be flattened in the manner of a shearing movement.

When the closure part 9 completely reaches the inserted position, the adjusting member strikes against the magazine body 2 and carries it along in continuation of the movement of the ejector 23. As a function of its position securing in the filling position the magazine body 2 can be carried along at the start of the return movement of the feed head 17 by the spring 22 or by means of the closure part 9 through the ejector 23 until this movement is ended by a stop or a counterforce and only then is the closure part 9 completely pressed into the magazine body 2. This stop is appropriately found by the magazine body 2 at the associated end of its outer closure part 8 which is ready in its movement path in the described way and which is correspondingly engaged with slight press fit on the outer circumference. In this operation the front end of the closure part 9 carries the magazine body 2 with it to the opposite end of the closure part 8, so that then the magazine body 2 in the guide 47 is axially secured between the closure parts 8, 9 and during the further movement of the ejector 23 is brought from the position according to FIG. 4 approximately simultaneously into closure engagement with both closure parts 8, 9. The closure movement is transferred by means of the closure part 9, or after reaching its closure position, via the adjusting member 24 to the magazine body 2 and the closure process appropriately only begins when the passage 30 is already closed by the valve face 41.

During the filling and/or closure process by the feed means 50, the magazine body 2 is appropriately in a filling zone of the device 1, which is at least medium-tight or approximately air-tight closed with respect to the outside.

After engaging the magazine body 2 on the feed head 17 the closure part 8 is initially held by the engagement of its inner circumference on the associated outer edge of the face 6 of the magazine body 2. During the insertion of the feed head 17 into the feed head 16 the closure part 8 is placed in positionally secured manner in a holder 51, whilst the feed head 17 with the magazine body 2 passes on into the filling position. At the upper end of the inner wall 14 the holder has an inner circumferential portion widened with respect to the inner circumference 37 and which can be widened in funnel-shaped manner to the upper face of the inner wall 14 and is appropriately so adapted to the outside width of the closure part 8 that the latter has a limited radial clearance with respect to the holder 51 and which is e.g. at least enough for it to be radially, elastically widened by the insertion of the magazine body 2.

The widened inner circumference is connected to the inner circumference 47 by means of a ring shoulder-like stop 53 for the associated face of the closure part 8, which projects slightly in the stop position over the upper face of the inner wall 14. The holder 51 has a tubular holding-down device 54 associated with the feed head 17 but axially movable independently thereof and which is traversed by the adjusting rod 22 and into which can be introduced in a complete and contact-free flush manner the feed head 17. The front or lower face of the holding-down device 54 forms a securing face 55, which can be moved with slight axial clearance or axial pressure against the face of the closure part 8 remote from the stop 53 and namely at the earliest after placing the closure part 8 on the stop 53 or at the latest before the magazine body 2 runs up onto the closure part 8 during the ejection or closure process.

For the closure part 9 is provided a corresponding holder 52, which is appropriately formed by a mandrel projecting freely over the adjusting member 24 and on which is so engaged with radial clearance the closure part 9 that its associated face strikes against the adjusting face 24 and its other face is substantially in one plane with the free face of the holder 52. Prior to the insertion of the feed head 17 with the magazine 2 into the feed head 16, the holder 52 is completely extended out of the body 10 and the cover 15, so that the closure part 9 is engaged and then the holder 52 can be retracted into the described, first functional position in which the closure part 9 is substantially located within the adjusting spring 22.

During the closure process the outer edge of the face 6 runs against the partly funnel-shaped widened inner circumference of the closure part 8. During a further ejection movement the magazine body 2, accompanied by self-centring alignment of the closure part 8, penetrates the latter, so that the closure of the inlets 4 is uninterruptedly taken over by the inner circumference of the closure part 8. As a function of the friction ratios approximately simultaneously the closure part 9 is pressed into the inner circumference 43 and the feed head 17 is forced out of said inner circumference, so that there is an interruption-free transition from the closure through the feed head 17 to the closure through the closure part 19. The closure part 8 is supported on the retaining faces against the insertion forces.

Figure 5:
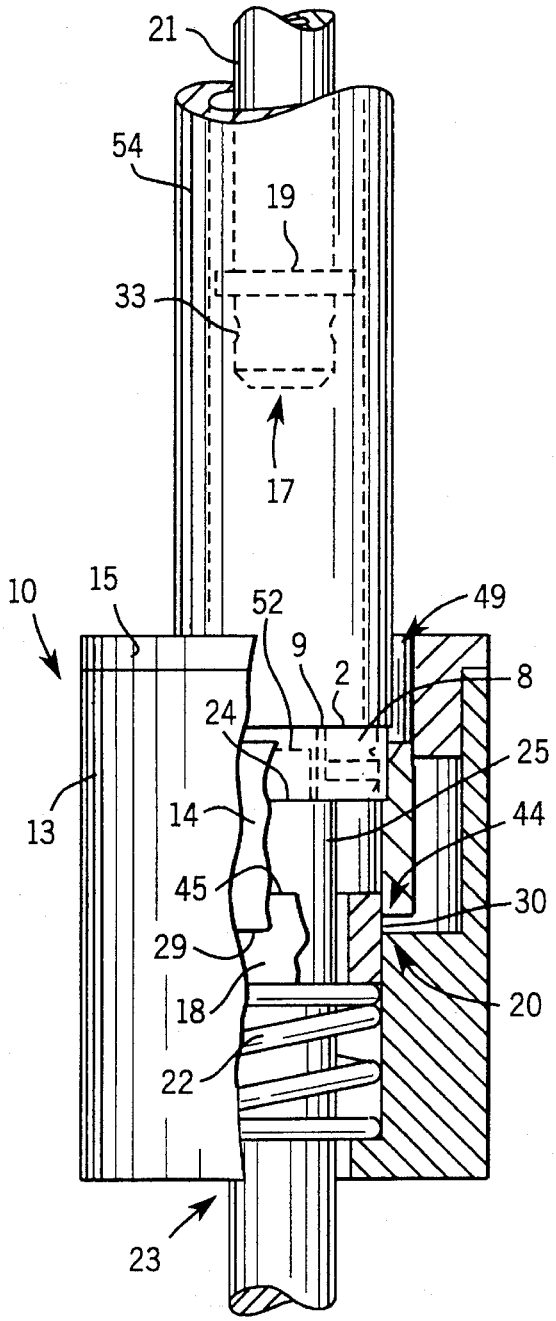

Following the closure according to FIG. 5 the holding-down device 54 according to FIG. 6 is moved completely out of the body 10 or the cover 15 and the feed head 17 is completely introduced into the holding-down device 54, so that the upper ejection side of the feed head 16 is freely accessible. By further moving out of the ejector 23 the closed magazine body 2 is moved entirely out of the upper outside of the feed head 16, so that it is freely accessible between the feed heads 16, 17 or the body 10 and the holding-down device 54 and can be removed from the holder 52 supporting it in centring manner.

In the case of the closure arrangement according to the invention the closure part 8 or 9 has in a single short axial area a locking member 56 or 58, which is appropriately positioned in such a way that it only engages or locks with the magazine body 2 towards the end of the closure movement. The locking member 56 or 58 can e.g. be a collar-like projecting snap bead, which as a result of the radial resilience characteristics of the closure jacket is widenable and elastically springs back to the locking position. In the case of closure part 8 the locking member 56 on the inner circumference is directly adjacent to the end face engaging on the retaining face 55, whilst in the case of the closure part 9 the locking member 58 on the outer circumference is immediately adjacent to the end face facing or engaging on the support face 24. As a countermember 57 or 59 for the locking member 56 or 58, the magazine 2 has a corresponding annular groove on the outer or inner circumference and spaced from the area in which the magazine chambers 3 are located.

To avoid an excessive evacuation of the storage chamber 12 by repeated vacuum-filling processes, it can be provided with a vent means and it can be sufficient to have extremely fine ventilating passages, e.g. in the seating faces of the cover 15 or as a result of the bearing clearance between the valve faces 41, 42 and the associated guide faces. In the latter case the passage 30 or the medium there could also be vented and this would make it even more difficult for the medium to trickle out of the passage 30. In the closed state, besides being bounded by the magazine body 2, the base 26 and the inner wall 14, the filling zone is also bounded by the closure part 8 tightly engaging with its end faces and the holding-down device 54.

In order that by loosening or fluidizing the medium, particularly within the storage chamber 12 for the feed medium 50 it occurs in homogeneous manner at the passage channel 28 or at the passage opening 30, it is possible to provide a stirring device 60 and/or a flow intensifier 61 or the like. The stirring device 60 can e.g. have one or more stirring members, such as stirring rods 62, projecting from the inner face of the cover 15 and which are moved in contact-free manner relative to the remaining components by all or part of the storage chamber 12, e.g. about an axis spaced adjacent or approximately parallel to the particular stirring rod 62. If the stirring members are not movable in this operation relative to the cover 15 and are instead substantially fixed and freely projecting with respect to the facing face 31 of the storage chamber 12, then they can be rotated in motor and/or manual manner with the cover 15 about the axis 11 with respect to the storage chamber 12. If there are ribs 32 in the movement area of the stirring members 62, then they can be provided with corresponding cutouts for the approximate contact-free passage of the stirring members 62. Appropriately the particular stirring member 62 extends over at least half the associated axial extension of the storage chamber 12 or still further, but not into the axial area where the passage channel 28 or passage opening 30 is located and from which the free end of the stirring member 62 can have an axial spacing, so as to avoid excessive compactions. The storage chamber 12 can also be free from ribs 32.

For loosening the medium in the storage chamber 12, particularly in the vicinity of the passage channel 28 or the passage opening 30, appropriately the flow intensifier 61 is provided and this leads to an improved flowability of the medium in this area, e.g. by blowing in a medium, which can have one of the aggregate states referred to by means of the feed medium or can be formed by the latter. Into the bottom face 31 issue radially or in grid-like manner, circumferentially distributed inlets or nozzles 63 for said medium, which are oriented approximately axially parallel to the storage chamber 12 and/or can be directed in an inclined manner against the passage channel 28 or the passage opening 30. Differently directed nozzles 63 are also possible. The nozzles 63 issuing in the vicinity of the bottom face 31 are connected by means of short nozzle ducts to a common connecting channel provided in the body 10 and which issues at the outside of the body 10 into a connecting opening 64 for connection to a pressure source. The medium can be blown through the nozzle 63 in pulsating manner into the storage chamber 12 and against the stirring members 62, so that the medium is also homogenized. It is possible to associate with the particular nozzle 63 a sieve, which is e.g. located in the plane of the nozzle exit opening or the bottom face 31 and prevents the entry of medium into the nozzle channel. Whilst three uniformly circumferentially distributed stirring members 62 are sufficient, it is appropriate to have more nozzles 63 distributed around the axis 11. At least one nozzle 63 can be very close to the outer circumference of the storage chamber 12 or closer to the passage opening 30 than the inner circumferential surface of the storage chamber 12 can be directed against the edge face 29 and in the radial direction there are further nozzles 63 between the said faces.

Figure 8:
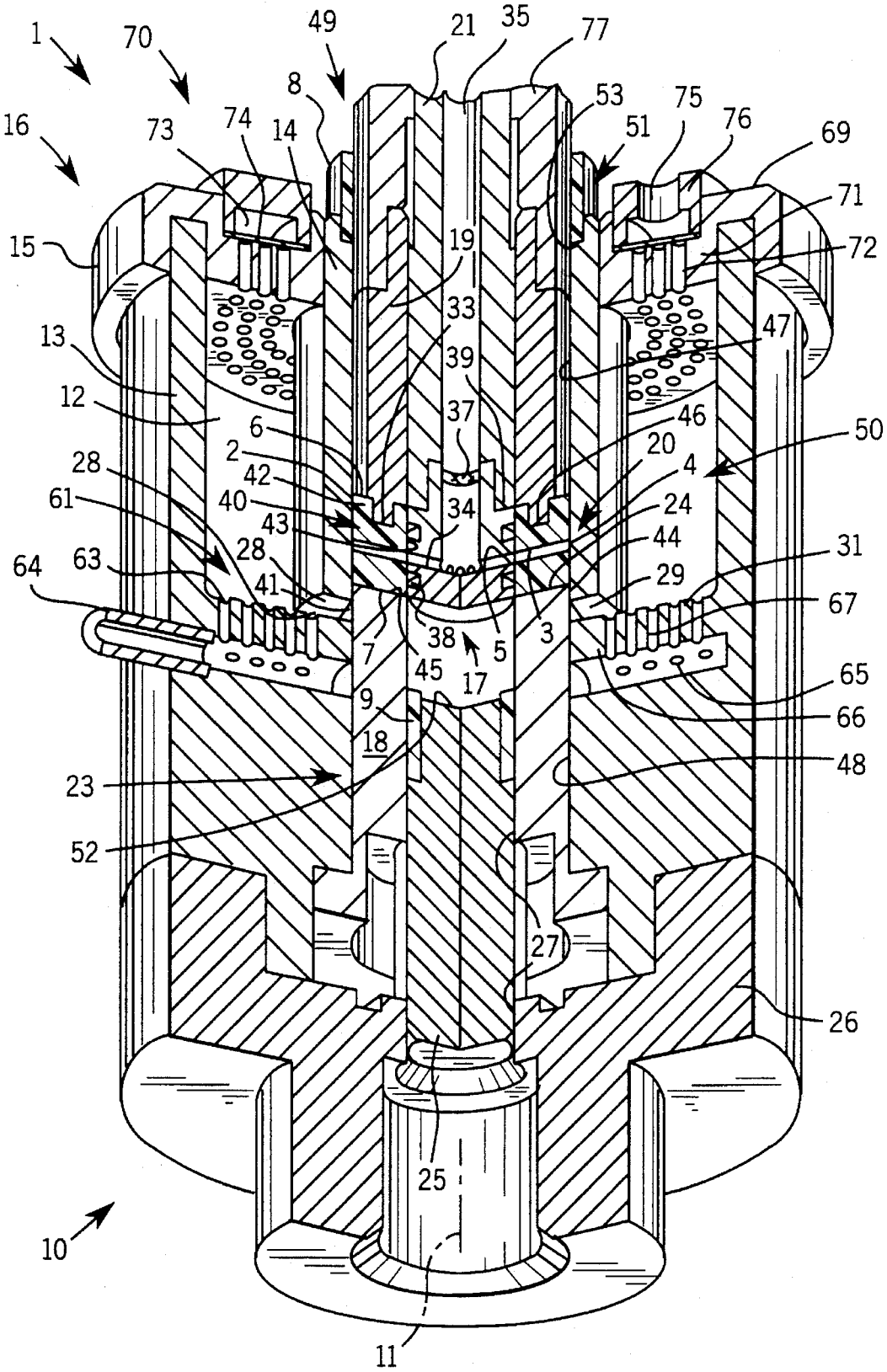

For the loosening device 61 according to FIG. 8, the face of the ring disk-like bottom wall 66 remote from the lowest bottom face 31 of the storage chamber 12 is adjacent to a ring chamber 65 extending over its entire surface extension and into which the connection 64 issues approximately over its entire height. With its inner circumference the wall 66 engages in pressure-tight manner on the cylindrical outer circumference of the adjusting member 18, through which is closed the otherwise open inner circumference of the pressure chamber 65. In the filling position part of the outer circumference 42 of the magazine body 2 closes in pressure-tight manner and only over a larger part of the axial extension engages on the inner circumference of the bottom wall 66, so that here again the chamber 65 is kept closed by the adjusting member 18. The bottom 66 is traversed by nozzle channels 67, whose ends form the equally wide passage openings 63. The intermediate spacing thereof is roughly the same as its width, so that in each area of the bottom surface 31 a turbulent pressure flow can be obtained.

In a corresponding arrangement, but smaller numbers and at a greater distance from the inner and/or outer circumference of the storage chamber 12, in the bottom face 31 at the furthest face of the cover 15 there are openings of exit channels 72 of an exit or discharge device 70 in such a way that the entire passage cross-section of the openings 63 is smaller than that of the channels 72. As a result of this constriction of the discharge, there is a certain overpressure in the storage chamber 12. The channels 72 traverse the ring disk-like end wall 71 of the storage chamber 12, which can carry at its inside and/or outside at least one sieve, filter 74, etc., through which passes the flow of all the channels 72 and which can be replaced in non-destructive manner.

All the channels 72 issue into a common, circular flat chamber 73 located on the outside of the storage chamber 12 or the cover 15 and forms a mountable component with the latter. At one point of its circumference on the end wall facing the channel 72 said chamber 73 has a single common outlet 75 for all the channels 72 and e.g. connected to a leading away line and through which the chamber 73, the sieve 74 and/or the channels 72 can be pressurized and therefore freed from any adhering powder. At one end face and two flank sides at an angle thereto the chamber 73 is bounded by a separate, circular and cross-sectionally U-shaped chamber body 76, which is inserted at least partly flush, in substantially tightly closing, but non-destructively detachable manner in a depression or circular groove in the outer end 69 of the cover 15. With its profile legs the chamber body 76 can press the sieve 74 on either side of the openings of the channels 72 covered by it against the bottom of the depression, so that after removing the chamber body 76 the sieve 74 is freely available for replacement purposes.

Through the cooperation of the devices 61, 70 even powder with a pronounced lump formation tendency, such as e.g. ultra-fine, micronized powder, can be kept flowable without any caking effect in the storage chamber 12 and can consequently be filled into the magazine chambers 3. By blowing air into the chambers 65 and from there through the nozzles 63 into the storage chamber 12, the powder therein is at least partly kept in a floating movement, so that through the filter 74 fine powder cannot pass out of the storage chamber 12. In the tank 12 the powder is constantly uniformly subject to air loosening action and there is no need for a tubular device 60.

The inner wall 14 is here formed by a sleeve-like component separate from the base 26 or the walls 13, 66 and whose edge face 29 passes over the circumference in uninterrupted manner and spaced from the bottom face 31, so that the ribs 32 are unnecessary. The wall 14 traverses the inner circumference of the cover 15 and can form a subassembly mountable therewith, so that after removing the circular cover 15 the casing area 12 has no inner boundary 14 and is accessible in large-area manner. The adjusting rod 21 is separate from the adjusting member 19, is axially displaceable and/or rotatable with respect thereto and is provided so as to tightly engage on the inner circumference of the adjusting member 19, so that the adjusting face 46 can be adjusted with respect to the feed head 17. The adjusting member 19 is placed in non-destructive, replaceable manner on one end of a tubular adjusting rod separate from the adjusting rod 21 and adjustably guided on its outer circumference, so that as a function of the construction of the magazine body 2 different adjusting members 9 can be used.

In its face 6 the magazine body 2 has a circular groove, in which can engage in firmly seated manner the adjusting member 19 with a front ring, so that after filling the magazine body 2 can be withdrawn from the feed head 16 or the inner wall 14 and can be drawn into the closure part 8. During the filling process the latter is substantially or completely outside the axial area of the storage chamber 12 on the outside of the cover 15 and with a spacing with respect to the outer circumference of the adjusting body 77, which can be so connected by means of a coupling detachable at any time during operation to the adjusting member 19 that in the released state between said two bodies 19, 17 can be transversely inserted a closure part 8 and then, accompanied by the closing of the coupling, can be moved against the stop 53.

Between the magazine body 2 and the adjusting member 19 or the feed head 17 there is a substantially positive rotation prevention or an accurately predetermined rotary positioning and which can e.g. be formed by toothed engagement in the vicinity of the face 6 or 46 and ensures that the transverse channels 34 are precisely aligned with the magazine chambers 3. The closure parts 8, 9 have no locking means 56 to 59 according to FIG. 1 and are therefore exclusively held by frictional forces and free from snapping connections on the magazine body 2. Therefore the outer circumference of the closure 8, 9 can be centred or guided in full-surface manner on the inner circumference of the adjusting member 18. The outer circumference of the holder 52 engages in substantially full-surface, centring manner in the inner circumference of the closure part 9.

The adjusting or thrust face 24 and the face 45 are here formed together by the same face of the adjusting member 18, so that the latter can eject from the filling position the filled magazine body 2, under the action of the spring means 22 and up to the starting position according to FIG. 8. For the frontal engagement of the closure part 9, the adjusting rod 25 consequently has a ring shoulder, so that the latter could be introduced into the inner circumference 43 of the magazine body 2. The adjusting rod 25 is guided by its outer circumference in closely engaging or centred manner on the inner circumference 27 of both the adjusting member 18 and the base 26. At its end remote from the cover 15, the base 26 can be closed with a non-destructively detachable ring cover, after whose removal it is possible to extract the adjusting member 18 and its spring to the associated end from the body 10, the adjusting rod 25 also being extractable to this side, so as to be able to place the next closure part 9 on the holder 52. At its outer end the base cover forms an external width-reduced, sleeve-like support mandrel, with which it is possible to insert the filling device in accurately centred, standing and non-destructively detachable manner in a device bracket, which also carries means for the automatic insertion of the closure parts 8, 9 in the working stroke of the filling device 1.

Here again the feed head 17 is fixed in non-destructively detachable and replaceable manner at the end of the adjusting rod 21, so that it can be adapted to different constructions of the magazine bodies 2.

The diameter of the magazine chambers 3 is approximately a few millimeters or 1 mm, so that through the magazine chambers 3, the passage channel 28 or the transverse channel 34 capillary-fine channels are formed. All the described characteristics, position determinations, effects, etc. can be provided precisely, substantially or approximately as described or diverging therefrom and the functions can also be brought about by means other than those described. In addition, each of the described parts or each arrangement can be provided once or two or more times, as a function of the particular requirements. For example, there can be two or more identical and/or different filling devices combined to a unit, so as to be able to simultaneously and/or successively fill a plurality of magazine bodies 2.

We claim:

1. A filling device for filling a magazine chamber (3) with a dose quantity of a non-gaseous fluent treatment medium in a filling phase, the magazine chamber (3) traversing a magazine body (2) and having first and second chamber ends (4, 5) traversing first and second body faces (42, 43) of the magazine body (2), said first chamber end (4) providing an outlet for discharging the treatment medium out of the magazine chamber (3) when applying the treatment medium remote from said filling device (1), said filling device (1) comprising:

a magazine receptacle (47) for inserting and holding the magazine body (3) during the filling phase and for allowing removal of the magazine body (3) after the magazine chamber (3) is filled;

a discharge orifice (30) for ejecting the treatment medium through the first chamber end (4) into the magazine chamber (3) while being held in said magazine receptacle (47), said magazine receptable (47) providing a counter face (47) traversed by said discharge orifice (30), in said filling phase said discharge orifice (30) being sealingly connected to the first chamber end (4) in the vicinity of said counter face (47); and charging means (50) for conveying the dose quantity through said discharge orifice (30) into the magazine chamber (3), said charging means (50) including feed means for effecting a carrier flow of a feed fluid for carrying the dose quantity into the magazine chamber (3) and for venting the magazine chamber (3) through the second chamber end (5) during filling of the magazine chamber through the first chamber end (4), wherein in said filling phase said discharge orifice (30) sealingly coincides with the first chamber end (4).

2. The device according to claim 1, wherein said carrier flow is at least partly a suction flow sucked through the magazine chamber (3).

3. The device according to claim 1, wherein said carrier flow is at least partly provided by a gaseous feed fluid, said charging means (50) being provided for substantially uninterruptedly filling the magazine chamber (3) with the treatment medium whilst leaving at the most minute quantities of the feed fluid in the magazine chamber (3).

4. The device according to claim 1, wherein said charging means (50) provides a vacuum filling of the magazine chamber by introducing the carrier flow into the first chamber end (4) of the magazine chamber (3) and leaving behind the treatment medium in the magazine chamber while passing the carrier feed flow out from the second chamber end (5) facing the first chamber end (4).

5. The device according to claim 1, further comprising a medium retaining device (36) associated with the second chamber end (5) for retaining the treatment medium in the magazine chamber (3) while passed by said carrier flow.

6. The device according to claim 1, further comprising first and second feed units (16, 17) for guiding said carrier flow, said first and second feed units (16, 17) being connectable in substantially medium-tight manner to both the first and second chamber ends (4, 5) when the magazine body (2) is inserted in said magazine receptacle (47), said first and second feed units (16, 17) being telescopically movable against one another and with respect to the magazine chamber (3) between filling connection positions and release positions.

7. The device according to claim 1, further comprising at least one positioning member (18, 19, 24) for positionally displacing the magazine chamber (3) between operating positions.

8. The device according to claim 7, wherein said at least one positioning member (19, 24 or 18) provides at least one of a feed head (17), a positively controlled positioning body and a spring-controlled adjusting body.

9. The device according to claim 1, further comprising a mounting support, said mounting support having at least one of a fastening device (20) for the magazine chamber (3), and adjusting members (19, 18) oppositely placeable against end faces (6, 7) of the magazine body (2).

10. The device according to claim 1, further comprising at least one filling valve (40) and at least one valve body (41, 42) movable between valve positions said valve body (41, 42) being constructed as a valve slide, said valve body (42, 41) being formed by at least one of a magazine body (2), an adjusting member (18) for the magazine body (2), and at least one magazine closure (9).

11. The device according to claim 10, wherein said filling valve (40) provides at least one valve opening (30), for operating at least one of said valve opening (30) at least two alternately, substantially uninterruptedly and successively engageable valve bodies (41, 42) being provided.

12. The device according to claim 1, further comprising at least one storage chamber (12) for the medium, in a filling state said storage chamber connecting substantially directly to the at least one medium chamber (3) via at least one medium passage (30).

13. The device according to claim 1, further comprising at least one storage chamber (12) for holding the medium in readiness close to a medium delivering passage (30), means being provided for substantially sealingly closing said storage chamber (12) with the exception of said delivering passage (30).

14. The device according to claim 12, wherein said storage chamber (12) has a substantially lowermost bottom wall (13), said storage chamber (12) being connectable to the medium chamber (3) substantially directly adjacent to said bottom wall (13) and being at least partly constructed as a column store extending substantially vertical above said bottom wall (13) and said medium passage (30).

15. The device according to claim 12, wherein said storage chamber (12) is associated with at least one device (60, 61) for loosening the medium by moving the medium within the storage chamber (12) in a direction different from a downward direction.

16. The device according to claim 12, further comprising means for emanating medium flows substantially from the vicinity of a bottom boundary (31) into said storage chamber (12).

17. The device according to claim 12, further comprising an outlet device (70) including a medium retaining device (74) and a collecting chamber (73) connected to a plurality of outlet channels (72), said outlet device (70) and said medium retaining device being located in the vicinity of an upper cover boundary of said storage chamber (12).

18. The device according to claim 1, wherein said feed means (50) provides at least one connecting opening (30, 33) for the magazine body (2) having a plurality of juxtaposed magazine chambers (3) arranged round a magazine axis (11), at least one of said connecting openings (30, 33) being common for at least a part of the plurality of the magazine chambers (3).

19. The device according to claim 18, wherein at least one of said connecting openings (30, 33) and at least one medium retaining devices (36) is annular, at least one of said connecting openings (30) providing a valve opening.

20. The device according to claim 1, further comprising at least one body (10) having an outer wall (13) and an inner wall (14), between said outer and inner walls (13, 14) said body (10) bounding a substantially annular storage chamber (12) for the medium.

21. The device according to claim 1, further comprising a storage chamber (12) having a chamber end (31) and a medium outlet (30), and an annular valve body (18) for opening said medium outlet (30) adjacent to said chamber end (31), said valve body (18) being displaceable in common with the magazine body (2) against a spring member (22).

22. The device according to claim 6, wherein said second feed unit (17) is connectable to a feed source, means being provided for engaging and disengaging said second feed unit (17) with respect to a circumferential inner wall (14) of said first feed unit (16).

23. The device according to claim 1, further comprising a storage chamber (12) bounded by an inner wall (14), said inner wall (14) providing a guide for at least one of the magazine body (2), a valve body (18), a storage closure (44), and a magazine closure (8).

24. The device according to claim 1, further comprising a feed head (17) for feeding the medium and an ejector (23) for ejecting the magazine body (2), said feed head (17) opposing said ejector (23), both said feed head (17) and said ejector (23) being separately displaceable.

25. The device according to claim 12, wherein said storage chamber (12) has an inner wall (14) providing an edge face (29), said edge face (29) bounding said medium passage (30).

26. The device according to claim 1, further comprising means (49) for closing at least one magazine chamber (3) in the vicinity of at least one chamber opening (4, 5) substantially within said device (1) with at least one magazine closure (8, 9) and to eject the magazine body (2) common with the magazine closure (8, 9).

27. The device according to claim 26, further comprising a storage chamber (12) and a drive member (23) for the magazine body (2), said storage chamber (12) having a wall (14), at least one of said wall (14) and said drive member (23) providing a mounting support (51, 52) for the aligningly receiving at least one of the magazine closure (8, 9).

28. The device according to claim 1, wherein the magazine chamber has at least one chamber opening (4, 5) closeable with at least two separate closure members (8, 14), means being provided for successively exchanging said closure members while substantially uninterruptedly keeping the at least one chamber opening (4, 5) closed, one of said closure members (8) providing a common unit with the magazine body.

* * * * *

UNITED STATES PATENT AND TRADEMARK OFFICE

CERTIFICATE OF CORRECTION

PATENT NO. : 5,519,980

DATED : May 28, 1996

INVENTOR(S) : Guentert et al.

It is certified that error appears in the above-identified patent and that said Letters Patent is hereby corrected as shown below:

In the Claims:

Claim 1, column 15, line 8 "receptable " should be--receptacle--.

Signed and Sealed this

Twenty-ninth Day of June, 1999

*Attest:*

Q. TODD DICKINSON

*Attesting Officer*

*Acting Commissioner of Patents and Trademarks*